US009775221B2

(12) United States Patent
Kim et al.

(10) Patent No.: US 9,775,221 B2
(45) Date of Patent: Sep. 26, 2017

(54) LAMP CONTROL APPARATUS

(71) Applicant: LG INNOTEK CO., LTD., Seoul (KR)

(72) Inventors: Joo Hoon Kim, Seoul (KR); Sang Beom Kim, Seoul (KR); Dong Yeol Han, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/215,885

(22) Filed: Jul. 21, 2016

(65) Prior Publication Data

US 2017/0027044 A1 Jan. 26, 2017

(30) Foreign Application Priority Data

Jul. 21, 2015 (KR) ..... 10-2015-0103029

(51) Int. Cl.
*H05B 37/00* (2006.01)
*H05B 37/02* (2006.01)
*H05B 33/08* (2006.01)

(52) U.S. Cl.
CPC ..... *H05B 37/0272* (2013.01); *H05B 33/0845* (2013.01)

(58) Field of Classification Search
CPC ..... H05B 37/0272; H05B 37/0218; H05B 41/3922; H05B 41/34; H05B 33/0803; H05B 39/09; H05B 41/28; H05B 33/0809; Y02B 20/46; F21V 23/0442
USPC ..... 315/127, 149, 200 R, 209 R, DIG. 4
See application file for complete search history.

(56) References Cited

U.S. PATENT DOCUMENTS

2015/0185752 A1* 7/2015 Bard ..... G05F 1/66 700/296
2015/0189724 A1* 7/2015 Karc ..... H05B 37/0272 315/149

* cited by examiner

*Primary Examiner* — Minh D A
(74) *Attorney, Agent, or Firm* — LRK Patent Law Firm

(57) ABSTRACT

A lamp control apparatus includes a radio signal control module configured to receive a dimming signal from the outside, to generate a lamp control signal, and to amplify the lamp control signal by a predetermined amount, a driver configured to receive the lamp control signal amplified by the radio signal control module and to control a lamp, and a power supply module configured to supply driving power to the radio signal control module or the driver.

14 Claims, 6 Drawing Sheets

| PWM duty cycle | Input | Output | Gain | Second resistor | First resistor |
|---|---|---|---|---|---|
| 100% | 3.3V | 10V | 3.03 | 1kΩ | 2k+30Ω |
| 1% | 0.033V | 0.1V | | | |

FIG. 4

LAMP CONTROL APPARATUS

CROSS REFERENCE TO RELATED APPLICATION

The present application claims the benefit of Korean Patent Application No. 10-2015-0103029 filed in the Korean intellectual Property Office on Jul. 21, 2015, the entire contents of which are incorporated herein by reference.

BACKGROUND OF THE INVENTION

1. Technical Field

The present invention relates to a lamp control apparatus including a radio signal control module for receiving a dimming signal from the outside, generating a lamp control signal, and amplifying the lamp control signal by a predetermined amount, a driver for receiving the lamp control signal amplified by the radio signal control module and controlling a lamp, and a power supply module for supplying driving power to the radio signal control module or the driver.

2. Description of the Related Art

A light-emitting diode (LED) is a kind of semiconductor device for converting electric energy into light. An LED has advantages of low consumption power, a semi-permanent lifespan, a fast response speed, safety, and an eco-friendly property compared to existing light sources, such as a fluorescent lamp and an incandescent. In particular, an LED lamp device can perform various productions through control of the blinking sequence of a plurality of arranged LEDs, light-emitting color, and brightness.

A lot of research is being carried out in order to replace the conventional light sources with LEDs. An LED tends to be increasingly used as the light sources of lamp devices, such as various lamps used indoors, liquid crystal display devices, electric bulletin boards, and streetlamps. In particular, an LED is used as common lamps for indoor interior, a stage lamp for producing a specific atmosphere, an advertising lamp, and a view lamp.

A lamp is an elapse lamp and may be installed in an outer wall of a building, a park, a streetlamp, a bridge rail or a theater. The size and application system of a lamp may be different depending on use, a target or a location to which the lamp device is applied. That is, lamps for an outer wall of a building are installed in an outer wall of a building in a belt form and are used to simply display a single color or a combined color through a blinking function. Lamps for a park, a streetlamp or a bridge rail are irregularly installed depending on the shape of the subject and are used to change their blinking or colors.

An LED lamp has propagated rapidly due to a long lifespan and high efficiency compared to conventional lamps. A dimmer capable of changing luminous intensity in response to a change of weather and over time has been commercialized. The type of method for controlling such a dimmer may be divided into wireless communication and wired communication. In particular, wireless communication is used, brightness is controlled by adjusting a Dim (+−) line within each driver.

Furthermore, dimming control of lamp devices recently used in various fields requires very precise control. There is a need to precisely control a lamp device with various luminous intensities depending on user needs, such as weak/middle weak/middle/middle strong/strong out of simple on/off.

However, a recent wireless dimmer has a complicated circuit configuration because it includes various functions using a microcomputer, and thus the configuration of a PCB pattern is also complicated due to an integrated circuit. Accordingly, there is a disadvantage in that universality is low due to a rise of a cost in the utilization of a PCB. Accordingly, research has been carried out on various and precise dimming control schemes for a lamp control apparatus, which can configure a circuit that rejects the enlargement and congestion of parts and can supplement mass production through a simple circuit implementation.

SUMMARY OF THE INVENTION

Embodiments of the present invention are directed to the provision of a lamp control apparatus which can generate a lamp control signal, amplify the lamp control signal using an amplification circuit, and perform lamp control for the purpose of precise dimming control in lamp control of the lamp control apparatus as described above.

Technical objects to be achieved by the present invention are not limited to the object, and they may include various technical objects within the range evident to those skilled in the art from the following description.

A lamp control apparatus according to an embodiment of the present invention includes a radio signal control module configured to receive a dimming signal from the outside, to generate a lamp control signal, and to amplify the lamp control signal by a predetermined amount, a driver configured to receive the lamp control signal amplified by the radio signal control module and to control a lamp, and a power supply module configured to supply driving power to the radio signal control module or the driver.

Furthermore, in the input power sensing apparatus according to an embodiment of the present invention, the radio signal control module may include a communication unit configured to receive the dimming signal from the outside, a lamp control signal generation unit configured to generate the lamp control signal when the communication unit receives the dimming signal, an RC filter configured to smooth the lamp control signal, and an amplifier configured to amplify the smoothed lamp control signal by the predetermined amount.

In this case, in the input power sensing apparatus according to an embodiment of the present invention, the communication unit may receive a dimming signal of any one of ZigBee, Bluetooth, and Bluetooth low energy (BLE) methods.

Furthermore, in the input power sensing apparatus according to an embodiment of the present invention, the number of communication units may be plural, and the communication units may receive different dimming signals. Furthermore, the number of amplifiers may correspond to the number of communication units, and lamp control signals amplified by the respective amplifiers may be connected to a plurality of the drivers.

Furthermore, in the input power sensing apparatus according an embodiment of the present invention, the lamp control signal includes a pulse width modulation (PWM) signal.

Furthermore, the input power sensing apparatus according to an embodiment of the present invention, the lamp control signal generation unit, the RC filter, the amplifier, and the driver may be connected in series. In this case, the RC filter may include a filter resistor $R_f$ connected in series between the lamp control signal generation unit and the amplifier and a filter capacitor $C_f$ connected to a node between the amplifier and the filter resistor $R_f$ in parallel.

In the input power sensing apparatus according to an embodiment of the present invention, the amplifier may include an operational amplifier, a first resistor $R_1$ connected between an input stage and output stage of the operational amplifier, and a second resistor $R_2$ connected to a node between the input stage of the operational amplifier and the first resistor $R_1$ in parallel. In this case, the first resistor R1 or the second resistor R2 includes a variable resistor.

Furthermore, in the input power sensing apparatus according to an embodiment of the present invention, the power supply module may include supply power $V_{in}$, a rectification unit configured to rectify the supply power $V_{in}$ into rectification power $V_r$, a converter unit configured to convert the rectification power $V_R$ into preset first power $V_{c1}$, and a regulator configured to perform a voltage drop from the first power $V_{c1}$ to second power $V_{c2}$.

In this case, in the input power sensing apparatus according to an embodiment of the present invention, the first power $V_{c1}$ may be applied to the amplifier of the radio signal control module, and the second power $V_{c2}$ may be applied to the communication unit or lamp control signal generation unit of the radio signal control module. Furthermore, the converter unit may include an AC/DC converter or a DC/DC converter.

Furthermore, in the input power sensing apparatus according to an embodiment of the present invention, a plurality of the drivers may be connected in parallel to the output stage of the amplifier of the radio signal control module. In this case, one to eight drivers may be connected in parallel, and each of the drivers may have a consumption current of 2 mA.

Furthermore, in the input power sensing apparatus according an embodiment of the present invention, the driver controls an LED lamp.

BRIEF DESCRIPTION OF THE DRAWINGS

FIG. 4 is an exemplary diagram showing the voltages of the input stage and output stage of the radio signal control module in response to the lamp control signal of the lamp control apparatus according to an embodiment of the present invention.

DETAILED DESCRIPTION

Hereinafter, a "lamp control apparatus" according to an embodiment of the present invention is described in detail with reference to the accompanying drawings. Embodiments to be described are provided in order for those skilled in the art to easily understand the technical spirit of the present invention, and the present invention is not restricted by the embodiments. Furthermore, contents represented in the accompanying drawings have been diagrammed in order to easily describe the embodiments of the present invention, and the contents may be different from forms that are actually implemented.

Elements to be described herein are only examples for implementing the embodiments of the present invention. Accordingly, in other implementations of the present invention, different elements may be used without departing from the spirit and scope of the present invention.

Furthermore, an expression that some elements are "included" is an expression of an "open type", and the expression simply denotes that the corresponding elements are present, but should not be construed as excluding additional elements.

Furthermore, expressions, such as "the first" and "the second", are expressions used to only distinguish a plurality of elements from one another, and do not limit the sequence of the elements or other characteristics.

Furthermore, in the embodiments of the present invention, "power" may include all of kinds of electric energy which may be used in common electrical circuits, such as "voltage", "electric power", and "current."

Figure 1:
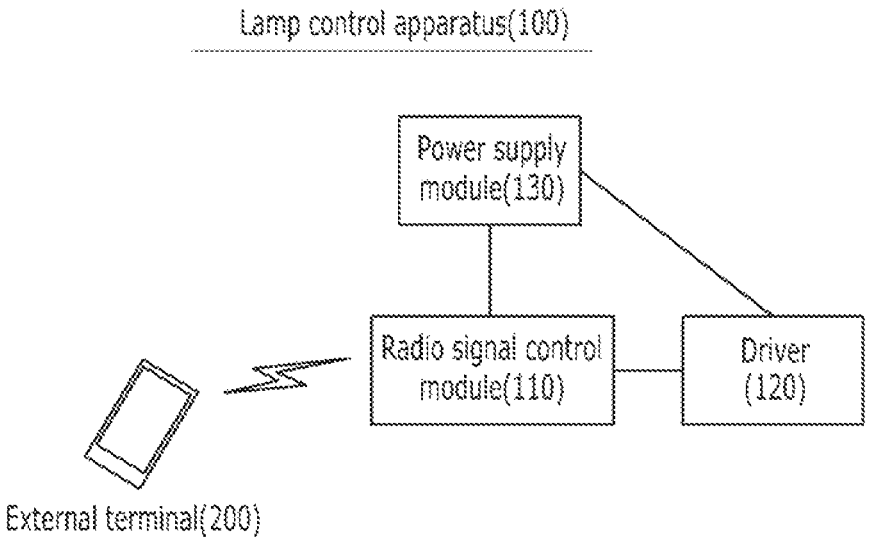
FIG. 1 shows a configuration illustrating a lamp control apparatus according to an embodiment of the present invention.

FIG. 1 shows a configuration illustrating a lamp control apparatus according an embodiment of the present invention.

Referring to FIG. 1, the lamp control apparatus 100 according to an embodiment of the present invention may include a radio signal control module 110, a driver 120, and a power supply module 130.

The radio signal control module 110 may receive a dimming signal from the outside, may generate a lamp control signal, and may amplify the lamp control signal by a predetermined amount. In this case, the radio signal control module 110 may receive the dimming signal from an external terminal 200 owned by a user so that a lamp is controlled. In this case, the external terminal 200 may include at least any one of a smart terminal, an in-home display, and a computer device.

The driver 120 may receive an amplified lamp control signal from the radio signal control module 110 and control a lamp. In this case, the driver 120 may control an LED lamp. Furthermore, the driver 120 may be connected to the lamp, and may turn on/off the lamp or adjust luminous intensity of the lamp in response to the lamp control signal.

In this case, a plurality of the drivers may be connected to the output stage of the amplifier of the radio signal control module in parallel. Accordingly, a plurality of lamps may operate at the same time. Furthermore, a maximum output current of the amplifier of the radio signal control module 110 according to an embodiment of the present invention is about 20 mA, and the consumption current of each of the drivers is 2 mA. Accordingly, one to eight drivers may be connected to the output stage of the amplifier of the radio signal control module in parallel.

The power supply module 130 may supply driving power to the radio signal control module 110 or the driver 120. In general, the power supply module 130 may rectify commercial power of 220V used in homes into DC power suitable for available power of the lamp control apparatus, and may supply the DC power.

Figure 2:
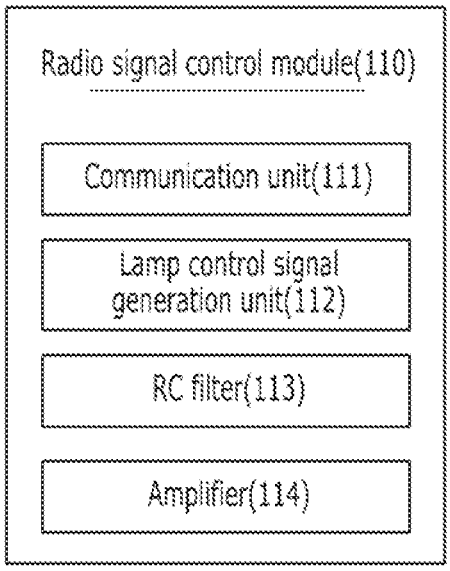
FIG. 2 shows a configuration illustrating the radio signal control module of the lamp control apparatus according to an embodiment of the present invention.
Figure 3:
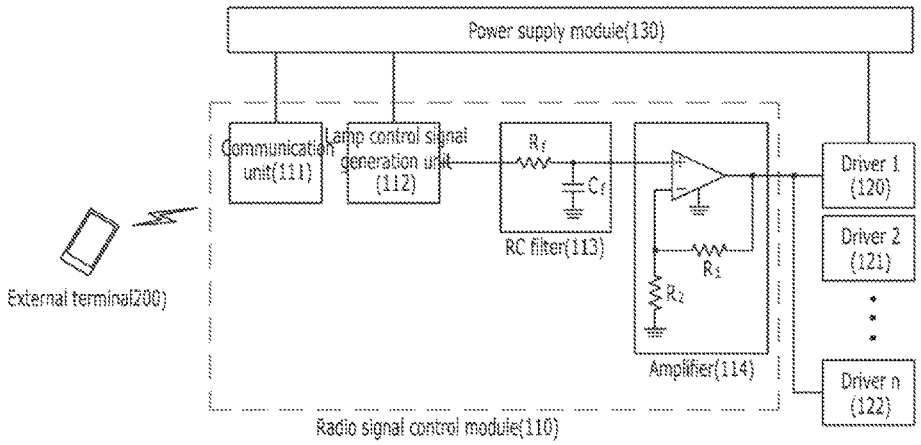
FIG. 3 is an exemplary diagram showing the circuit configuration of the radio signal control module of the lamp control apparatus according to an embodiment of the present invention.

FIG. 2 shows a configuration illustrating the radio signal control module of the lamp control apparatus according to an embodiment of the present invention, and FIG. 3 is an exemplary diagram showing the circuit configuration of the radio signal control module of the lamp control apparatus according to an embodiment of the present invention.

Referring to FIGS. 2 and 3, the radio signal control module 110 according to an embodiment of the present invention may include a communication unit 111, a lamp control signal generation unit 112, an RC filter 113, and an amplifier 114. In this case, the lamp control signal generation unit, the RC filter, the amplifier, and the driver may be implemented in such a way as to be connected in series.

The communication unit 111 receives a dimming signal from the outside. In this case, the communication unit 111 may include an input module or an external antenna, and may receive a dimming signal according to at least one of ZigBee, Bluetooth, and Bluetooth low energy (BLE) methods.

Furthermore, a plurality of the communication units 111 is used. The communication units may receive different dimming signals. For example, a first communication unit may receive a ZigBee dimming signal, a second communication unit may receive a Bluetooth dimming signal, and a third communication unit may receive a BLE dimming signal. Accordingly, although the number of external terminals 200 is plural, proper dimming control can be performed in response to a user' situation using dimming signals according to different methods.

The lamp control signal generation unit 112 generates a lamp control signal when the communication unit 111 receives a dimming signal. In this case, the lamp control signal may be a pulse width modulation (PWM) signal. The PWM signal refers to a signal in which the on duty of a high state is changed in a signal having a specific frequency and cycle. The rate of the PWM signal can be controlled by changing the on duty even in the same frequency. For example, if a PWM duty cycle is 100%, a waveform of a form, such as DC, appears. If a PWM duty cycle is 1%, a waveform in which the on duty of a high state is only 1% compared to a cycle appears.

The RC filter 113 smoothes a lamp control signal. In this case, if the lamp control signal is a PWM signal, a smoothed value is proportional to a PWM duty cycle. For example, referring to FIG. 4, it a PWM signal is 100%, a voltage at the input stage of the amplifier is smoothed to 3.3 V. If a PWM signal is 1%, a voltage at the input stage of the amplifier is smoothed to 0.033 V.

Furthermore, the RC filter 113 may include a filter resistor $R_f$ connected in series between the lamp control signal generation unit 112 and the amplifier 114 and a filter capacitor $C_f$ connected to a node between the amplifier 114 and the filter resistor $R_f$ in parallel. In this case, the degree of smoothing may be controlled by adjusting the size and input frequency of the filter resistor $R_f$ and the filter capacitor $C_f$.

The amplifier 114 amplifies a smoothed lamp control signal by a predetermined amount. In this case, the amplifier 114 may include an operational amplifier, a first resistor $R_1$ connected between the input stage and output stage of the operational amplifier, and a second resistor $R_2$ connected to a node between the input stage of the operational amplifier and the first resistor $R_1$ in parallel. Furthermore, the first resistor $R_1$ or the second resistor $R_2$ may include a variable resistor and control the gain value of the amplifier depending on a user need.

A gain value amplified by the amplifier 114 is determined by the relationship between the first resistor R1 and the second resistor R2, and may be determined according to the following equations.

$$\text{Gain}=1+(R_2/R_1)$$

Referring to FIG. 4, if the first resistor of the amplifier is set to 1 kΩ and the second resistor thereof is set to 2.03 kΩ, a gain is 3.03. Accordingly, if voltage at the input stage of the amplifier is 3.3 V, a voltage at the output stage of the amplifier becomes 10 V. If a voltage at the input stage of the amplifier is 0.033 voltage at the output stage of the amplifier becomes 0.1 V. In general, a voltage for driving a driver and a lamp is a 0~10 V DC voltage. Accordingly, the driving voltage of a dimmer can be precisely adjusted to 0.1~10 V by adjusting PWM to 1%~100%.

Furthermore, if a plurality of the communication units receives a plurality of dimming signals, the number of amplifiers may be implemented in accordance with the number of communication units. Lamp control signals amplified by the respective amplifiers may be connected to a plurality of the drivers. For example, if a dimming signal of a BLE method uses four channels, the number of communication units may be four. The amplifier may control a plurality of the drivers individually or in an integrated manner using four OP-AMP chips.

Figure 5:
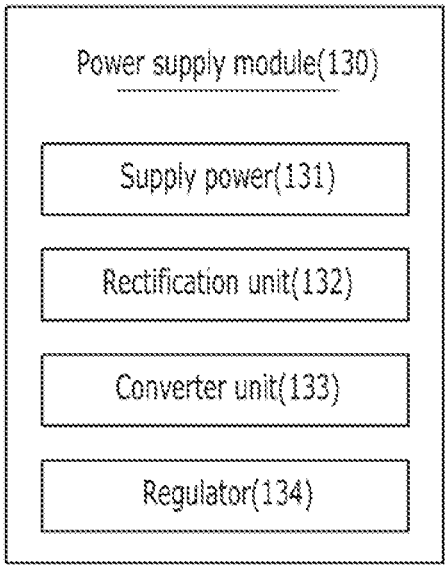
FIG. 5 shows a configuration illustrating the power supply module of the lamp control apparatus according to an embodiment of the present invention.
Figure 6:
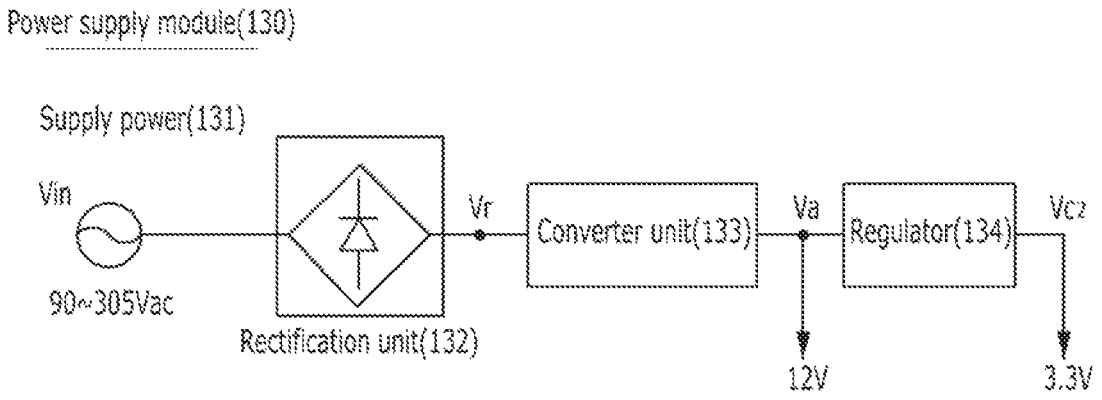
FIG. 6 is an exemplary diagram showing the circuit configuration of the power supply module of the lamp control apparatus according to an embodiment of the present invention.

FIG. 5 shows a configuration illustrating the power supply module of the lamp control apparatus according to an embodiment of the present invention, and FIG. 6 is an exemplary diagram showing the circuit configuration of the power supply module of the lamp control apparatus according to an embodiment of the present invention.

Referring to FIGS. 5 and 6, the power supply module 130 according to an embodiment of the present invention may include a supply power source 131, a rectification unit 132, a converter unit 133, and a regulator 134.

Supply power $V_{in}$ is power used in the lamp control apparatus 100, and may include all types of available power, such as commercial AC power and DC power.

The rectification unit 132 rectifies the supply power $V_{in}$ into rectification power Vr. A lamp connected to the driver is driven by DC power. However, common commercial power is AC power and thus needs to be converted into DC power. The rectification unit 132 according to an embodiment of the present invention may be implemented through a variety of types of rectification elements, such as a bridge rectifier, a half-bridge rectifier, and a full-bridge rectifier.

The converter unit 133 converts the rectification power Vr into preset first power $V_{c1}$. The converter unit 133 may convert rectified AC power of 90~305 V, that is, supply power, into DC power through an AC/DC converter. If supply power is DC power, the converter unit 133 may convert the DC power into DC power through a DC/DC converter which performs a voltage drop to a set voltage.

The regulator 134 performs a voltage drop from the first power $V_{c1}$ to second power $V_{c2}$. In this case, the first power $V_{c1}$ applied to the amplifier of the radio signal control module 110, and the second power $V_{c2}$ is applied to the communication unit 111 or lamp control signal generation unit 112 of the radio signal control module 110.

For example, referring to FIG. 6, the first power $V_{c1}$ may be converted into 12 V used in the amplifier of the radio signal control module 110. The second power $V_{c2}$ subjected to a voltage drop through the regulator may be converted into 3.3 V used in the communication unit 111 or the lamp control signal generation unit 112.

The lamp control apparatus according to an embodiment of the present invention can perform lamp control using a PWM signal and can perform very precise dimming control from 1% to 100% (0.1 V-10 V) using a non-inverting amplifier.

Furthermore, the lamp control apparatus according to an embodiment of the present invention can be used in the PCB space easily because a cost is reduced and the size of parts is reduced using a non-inverting amplifier without an additional circuit.

Furthermore, the lamp control apparatus according to an embodiment of the present invention can effectively control various types of lamps used in buildings and residence environments because it can receive dimming signals of various methods, such as ZigBee, Bluetooth, and BLE and can control various types of lamps identically or differently through dimming control in response to different dimming signals.

The aforementioned embodiments of the present invention have been disclosed for illustrative purposes, and the present invention is not restricted by the embodiments. Furthermore, those skilled in the art to which the present invention pertains may modify and change the present invention in various ways within the spirit and scope of the present invention, and such modifications and changes should be construed as belonging to the scope of the present invention.

What is claimed is:

1. A lamp control apparatus comprising:

a radio signal control module configured to receive a dimming signal from an outside, to generate a lamp control signal, and to amplify the lamp control signal by a predetermined amount;

a driver configured to receive the lamp control signal amplified by the radio signal control module and to control a lamp; and a power supply module configured to supply driving power to the radio signal control module or the driver, wherein the radio signal control module comprises:

a communication unit configured to receive the dimming signal from the outside;

a lamp control signal generation unit configured to generate the lamp control signal when the communication unit receives the dimming signal;

an RC filter configured to smooth the lamp control signal; and an amplifier configured to amplify the smoothed lamp control signal by the predetermined amount.

2. The lamp control apparatus of claim 1, wherein the communication unit receives a dimming signal of any one of ZigBee, Bluetooth, and Bluetooth low energy (BLE) methods.

3. The lamp control apparatus of claim 1, wherein:

a number of the communication units is plural, and the communication units receive different dimming signals.

4. The lamp control apparatus of claim 3, wherein:

a number of the amplifiers corresponds to a number of the communication units, and lamp control signals amplified by the respective amplifiers are connected to a plurality of the drivers.

5. The lamp control apparatus of claim 1, wherein the lamp control signal comprises a pulse width modulation (PWM) signal.

6. The lamp control apparatus of claim 1, wherein the lamp control signal generation unit, the RC filter, the amplifier, and the driver are connected in series.

7. The lamp control apparatus of claim 6, wherein the RC filter comprises:

a filter resistor $R_f$ connected in series between the lamp control signal generation unit and the amplifier; and a filter capacitor $C_f$ connected to a node between the amplifier and the filter resistor $R_f$ in parallel.

8. The lamp control apparatus of claim 1, wherein the amplifier comprises:

an operational amplifier;

a first resistor $R_1$ connected between an input stage and output stage of the operational amplifier; and a second resistor $R_2$ connected to a node between the input stage of the operational amplifier and the first resistor $R_1$ in parallel.

9. The lamp control apparatus of claim 8, wherein the first resistor $R_1$ or the second, resistor $R_2$ comprises a variable resistor.

10. A lamp control apparatus comprising:

a radio signal control module configured to receive a dimming signal from an outside, to generate a lamp control signal, and to amplify the lamp control signal by a predetermined amount;

a driver configured to receive the lamp control signal amplified by the radio signal control module and to control a lamp; and a power supply module, configured to supply driving power to the radio signal control module or the driver, wherein the power supply module comprises:

supply power $V_{in}$;

a rectification unit configured to rectify the supply power $V_{in}$ into rectification power $V_r$;

a converter unit configured to convert the rectification power $V_R$ into preset first power $V_{c1}$; and a regulator configured to perform a voltage drop from the first power $V_{c1}$ to second power $V_{c2}$.

11. The lamp control apparatus of claim 10, wherein:

the first power $V_{c1}$ is applied to the amplifier of the radio signal control module, and the second power $V_{c2}$ is applied to the communication unit or lamp control signal generation unit of the radio signal control module.

12. The lamp control apparatus of claim 10, wherein the converter unit comprises an AC/DC converter or a DC/DC converter.

13. A lamp control apparatus comprising:

a radio signal control module configured to receive a dimming signal from an outside, to generate a lamp control signal, and to amplify the lamp control signal by a predetermined amount;

a driver configured to receive the lamp control signal amplified by the radio signal control module and to control a lamp; and a power supply module configured to supply driving power to the radio signal control module or the driver, wherein a plurality of the drivers is connected in parallel to an output stage of the amplifier of the radio signal control module.

14. The lamp control apparatus of claim 13, wherein:

one to eight drivers are connected in parallel, and each of the drivers has a consumption, current of 2 mA.

* * * * *